US009153926B2

(12) United States Patent
Wu et al.

(10) Patent No.: US 9,153,926 B2
(45) Date of Patent: Oct. 6, 2015

(54) USB PLUG CONNECTOR AND METHOD FOR MANUFACTURING THE SAME

(71) Applicant: HON HAI PRECISION INDUSTRY CO., LTD., New Taipei (TW)

(72) Inventors: Zhuang-Zhi Wu, Kunshan (CN); Xue-Chao Wang, Kunshan (CN); Xiao-Li Li, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 49 days.

(21) Appl. No.: 14/161,918

(22) Filed: Jan. 23, 2014

(65) Prior Publication Data

US 2014/0213110 A1 Jul. 31, 2014

(30) Foreign Application Priority Data

Jan. 28, 2013 (CN) ..... 2013 1 0029442

(51) Int. Cl.

| | |
|---|---|
| ***H01R 24/00*** | (2011.01) |
| ***H01R 9/03*** | (2006.01) |
| ***H01R 43/26*** | (2006.01) |
| ***H01R 13/6585*** | (2011.01) |
| ***H01R 24/60*** | (2011.01) |
| *H01R 13/66* | (2006.01) |
| *H01R 43/24* | (2006.01) |

(52) U.S. Cl.

CPC ..... *H01R 43/26* (2013.01); *H01R 9/03* (2013.01); *H01R 13/6585* (2013.01); *H01R 24/00* (2013.01); *H01R 24/60* (2013.01); *H01R 13/6658* (2013.01); *H01R 43/24* (2013.01); *Y10T 29/49147* (2015.01); *Y10T 29/49208* (2015.01)

(58) Field of Classification Search

USPC ..... 439/607.22, 660, 626, 607.51–607.53, 439/607.54, 607.55, 607.59, 607.46, 607.47

See application file for complete search history.

(56) References Cited

U.S. PATENT DOCUMENTS

| | | | | |
|---|---|---|---|---|
| 7,341,487 | B2 * | 3/2008 | Wu | 439/607.51 |
| 7,361,059 | B2 | 4/2008 | Harkabi et al. | |
| 8,198,563 | B2 | 6/2012 | Tsai | |
| 8,461,465 | B2 | 6/2013 | Golko et al. | |
| 2009/0117784 | A1 * | 5/2009 | Wu | 439/660 |
| 2011/0250796 | A1 * | 10/2011 | Su et al. | 439/660 |
| 2012/0071022 | A1 * | 3/2012 | Su et al. | 439/449 |
| 2012/0100746 | A1 * | 4/2012 | Wu | 439/474 |
| 2013/0117470 | A1 | 5/2013 | Terlizzi et al. | |

FOREIGN PATENT DOCUMENTS

| | | |
|---|---|---|
| TW | M370848 | 12/2009 |

* cited by examiner

*Primary Examiner* — Abdullah Riyami
*Assistant Examiner* — Harshad Patel
(74) *Attorney, Agent, or Firm* — Ming Chieh Chang; Wei Te Chung

(57) ABSTRACT

A USB plug connector (100) includes an insulative housing (1), a number of contacts (2) retained in the insulative housing, a metal shield (3) covering the insulative housing, a PCB (4) soldered with the contacts, an insulative cover (5) partly molded over a part of the metal shield, and a cable (6) connecting to the PCB and electrically connected with the contacts. The metal shield includes a top wall (31), a bottom wall (32), a front wall (33) connecting with the top wall and the bottom wall, and a pair of sidewalls (34) extending from two lateral edges of the front wall and retained between the top wall and the bottom wall. Each sidewall has a pair of protrusions (35) respectively on an upper edge and a lower edge thereof. Each of the top wall and the bottom wall has a number of cutouts (312) correspondingly receiving the protrusions.

12 Claims, 7 Drawing Sheets

USB PLUG CONNECTOR AND METHOD FOR MANUFACTURING THE SAME

BACKGROUND OF THE INVENTION

1. Field of the Invention

The present invention relates generally to a USB (Universal Serial Bus) plug connector, and more particularly to a USB plug connector adapted for normal insertion and reverse insertion into a USB receptacle connector.

2. Description of Related Arts

Taiwan Patent No. M370848 discloses a USB plug connector. The USB plug connector comprises a metal shield peripherally defining a receiving space for receiving a mating USB receptacle connector. The USB plug connector has a PCB (printed circuit board) assembled in the receiving space of the metal shield for dividing the receiving space into an upper receiving space and a lower receiving space. The PCB has each four circuits on both the upper face and the lower face thereof. The upper four circuits and the lower four circuits are electrically connected with each other and therefore, the USB plug connector is adapted for normal insertion and reverse insertion into the USB receptacle connector. When the USB plug connector is normally inserted into the USB receptacle connector, the upper receiving space is used for receiving a mating portion of the USB receptacle connector; when the USB plug connector is reversedly inserted into the USB receptacle connector, the lower receiving space is used for receiving the mating portion of the USB receptacle connector. The mating portion of the USB receptacle connector has electrode traces electrically connected with the four circuits on the upper face of the PCB when the USB plug connector is normally inserted into the USB receptacle connector and electrically connected with the four circuits on the lower face of the PCB when the USB plug connector is reversely inserted into the USB receptacle connector. The metal shield is integrally formed into a rectangular shape which may cause an inconvenient and inaccurate assembling the metal shield around the PCB during the assembling process of the USB plug connector.

A USB plug connector adapted for normal insertion and reverse insertion into a USB receptacle connector is desired.

SUMMARY OF THE INVENTION

Accordingly, an object of the present invention is to provide a USB plug connector adapted for normal insertion and reverse insertion into a USB receptacle connector.

To achieve the above object, a USB plug connector includes an insulative housing, a number of contacts retained in the insulative housing, a metal shield covering the insulative housing, a PCB soldered with the contacts, an insulative cover molded over a part of the metal shield, and a cable connecting to the PCB and electrically connected with the contacts. The metal shield includes a top wall, a bottom wall, a front wall connecting with the top wall and the bottom wall, and a pair of sidewalls extending sidewardly from two lateral edges of the front wall and retained between the top wall and the bottom wall. Each sidewall has a pair of protrusions respectively on an upper edge and a lower edge thereof. The top wall and the bottom wall have a number of cutouts correspondingly receiving the protrusions.

Other objects, advantages and novel features of the invention will become more apparent from the following detailed description when taken in conjunction with the accompanying drawings.

DETAILED DESCRIPTION OF THE PREFERRED EMBODIMENT

Figure 1:
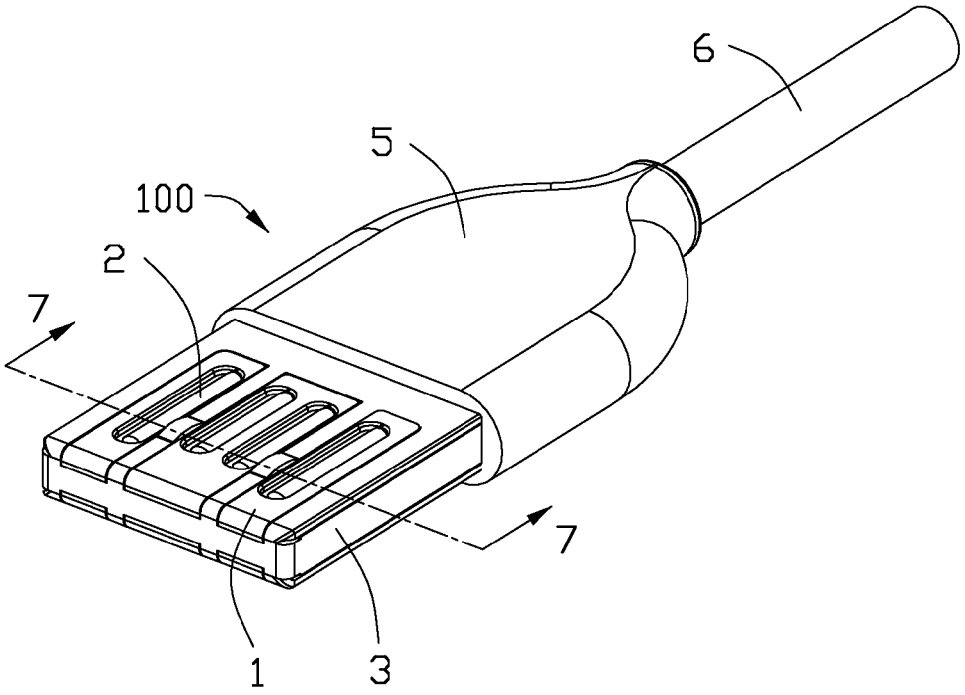
FIG. 1 is a perspective, assembled view of a USB plug connector constructed in accordance with the present invention.

Reference will now be made in detail to the preferred embodiment of the present invention.

Referring to FIGS. 1-7, a USB plug connector 100 of the present invention comprises an insulative housing 1, a plurality of contacts 2 retained in the insulative housing 1, a metal shield 3 covering the insulative housing 1, a printed circuit board (PCB) 4 soldered with the contacts 2, an insulative cover 5 partly over-molding the metal shield 3, and a cable 6 soldered with the PCB 4 for electrically connecting with the contacts 2.

Figure 2:
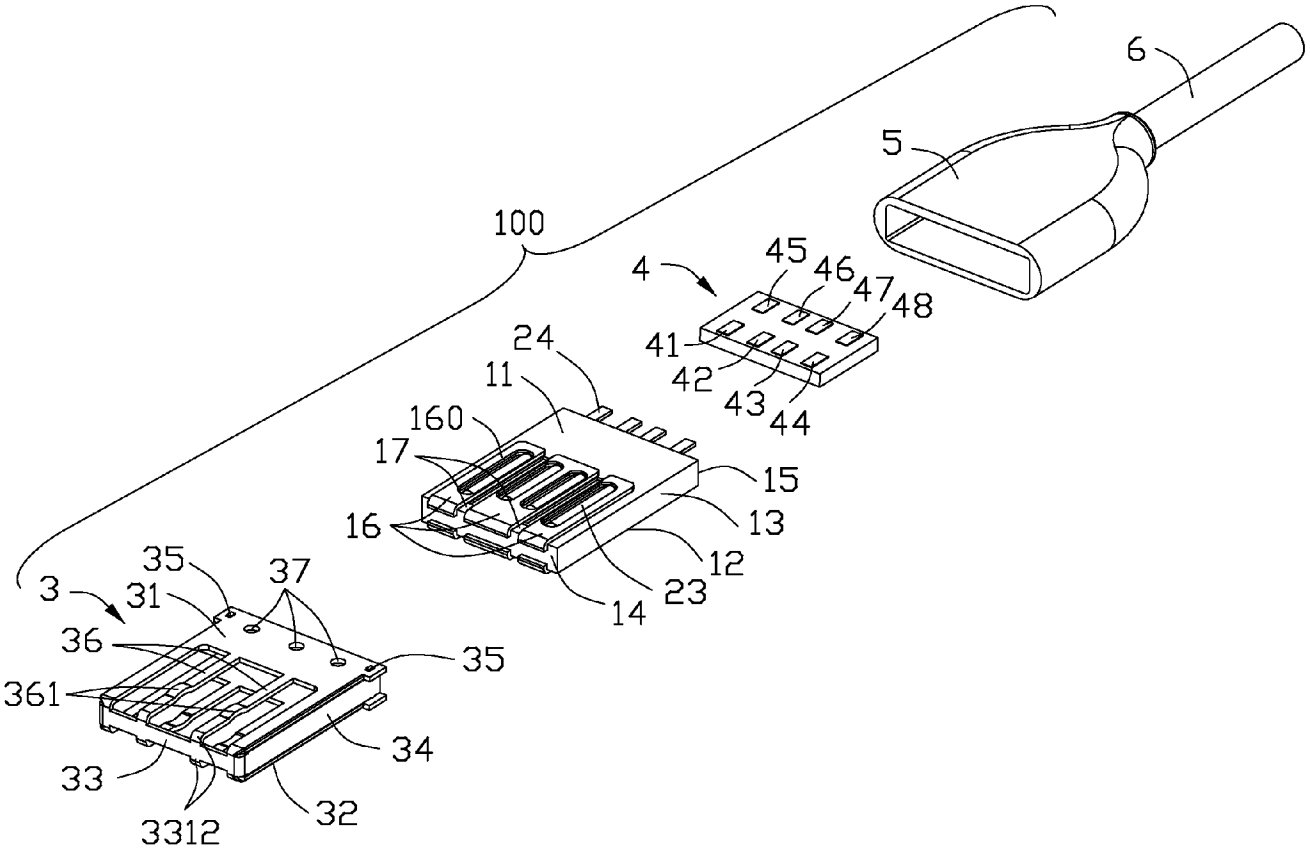
FIG. 2 is a perspective, exploded view of the USB plug connector.
Figure 3:
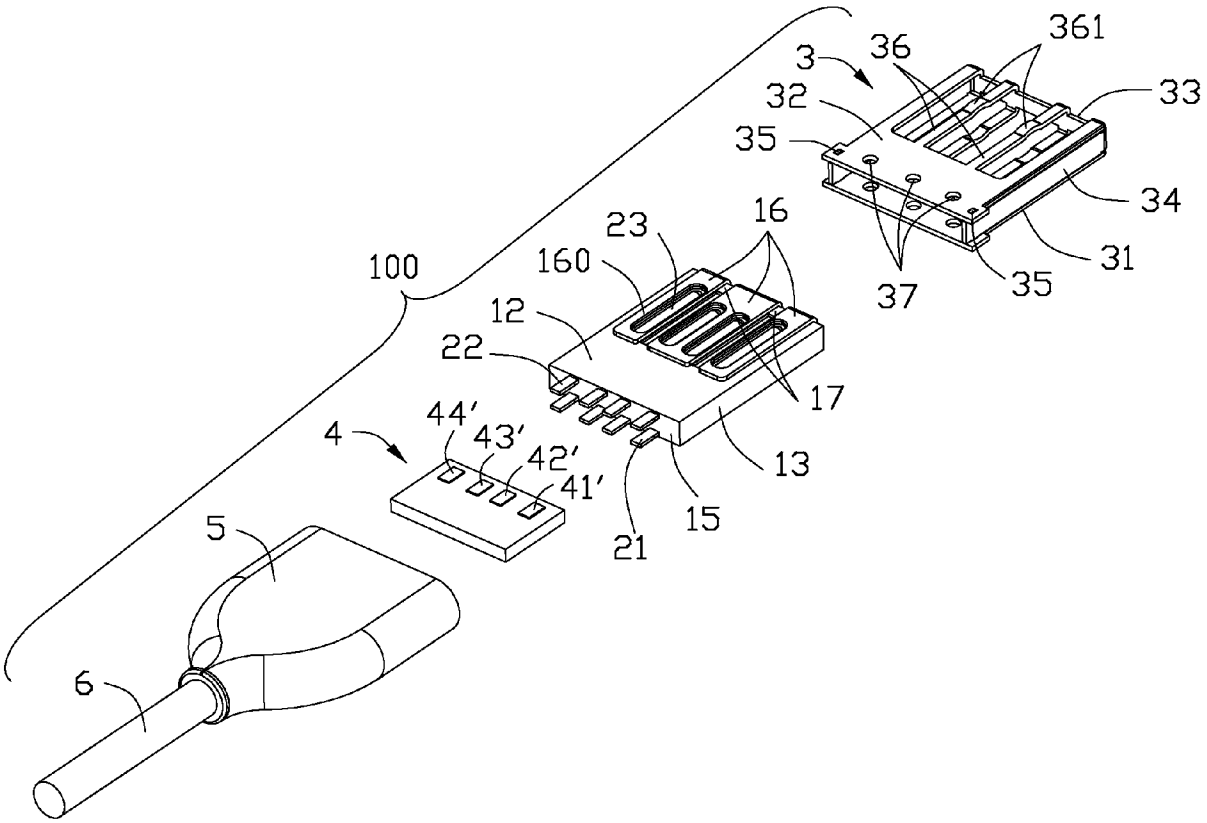
FIG. 3 is similar to FIG. 2 but taken from a different aspect.

Referring to FIGS. 2 and 3, the insulative housing 1 has an upper face 11, a lower face 12 opposite to the upper face 11, a pair of lateral faces 13 connecting with the upper face 11 and the lower face 12, a front face 14, and a rear face 15 opposite to the front face 14. The insulative housing 1 has a plurality of raised portions 16 protruding from both the upper face 11 and the lower face 12. The raised portions 16 extend along a mating direction along which the USB plug connector 100 is inserted into a mating USB receptacle connector (not shown). Each raised portion 16 defines a lengthwise extending slot 160. In a preferred embodiment, the raised portion 16 extends to the front face 14 for better engagement with the metal shield 3. A slit 17 is defined between every two adjacent raised portions 16 on both the upper face 11 and the lower face 12.

Figure 7:
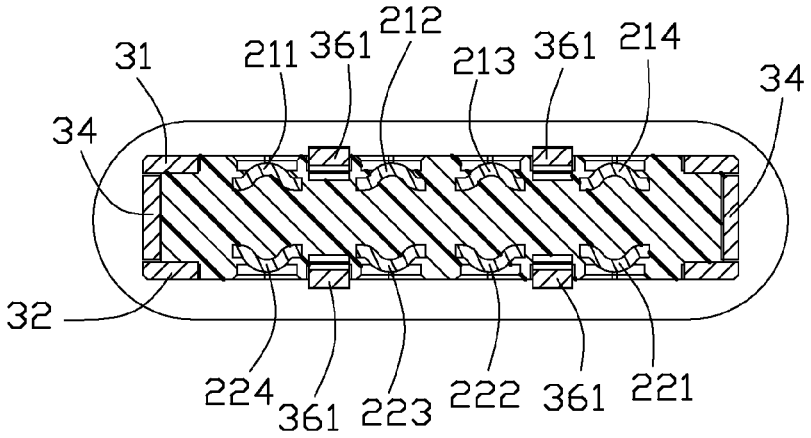
FIG. 7 is a cross-sectional view taken along line 7-7 of FIG. 1.

Referring to FIGS. 2, 3, 7, the contacts 2 comprise a row of upper contacts 21 and a row of lower contacts 22 respectively insert-molded in the upper face 11 and the lower face 12 of the insulative housing 1 so as to form a terminal module wholly. The upper contacts 21 and the lower contacts 22 are adapted for connecting with a same interface. The upper contacts 21 and the lower contacts 22 have reversed arrangement for both normal and reversed insertion into the USB receptacle connector. In detail, please referring to FIG. 7, the upper contacts 21 from left to right in sequence are: an upper power contact 211, an upper, first signal contact 212, an upper, second signal contact 213, and an upper grounding contact 214. The lower contacts 22 from left to right in sequence are: a lower ground contact 224, a lower, second signal contact 223, a lower, first signal contact 222, and a lower power contact 221. Each contact 2 has a contacting portion 23 extending forward into the lengthwise extending slot 160 of the insulative housing 1 and a soldering portion 24 backwardly extending out of the rear face 15 of the isolative housing 1. The contacting portions 23 are positioned in the lengthwise extending slots 160 and so, the contacting portions 23 are arranged in two upper and lower rows. The contacting portions 23 are wholly received in the lengthwise extending slots 160 and lower than the raised portions 16 for not interfering with the USB receptacle connector when mated. The soldering portions 24 are arranged in two upper and lower rows, too, and all extend through the rear face 15 of the insulative housing 1 for soldering with the PCB 4.

Referring to FIGS. 2 and 3, the PCB 4 is a board printed in two opposite surfaces. The PCB 4 has a plurality of first conductive pads 41, 42, 43, 44 at a front end of an upper surface thereof. The PCB 4 has a plurality of second conductive pads 41', 42', 43', 44' at a front end of a lower surface thereof. The first conductive pads 41, 42, 43, 44 and the second conductive pads 41', 42', 43', 44' are reversely arranged along a transverse direction perpendicular to the mating direction. The PCB 4 further has a plurality of third conductive pads 45, 46, 47, 48 at a rear end of an upper surface thereof. The first conductive pads 41, 42, 43, 44 and the second conductive pads 41', 42', 43', 44' are correspondingly soldered with the upper contacts 21 and the lower contacts 22. The third conductive pads 45, 46, 47, 48 are soldered with corresponding wires (not shown) of the cable 6. Therefore, the upper contacts 21 and the lower contacts 22 are electrically connected with the cable 6 via the PCB 4 for signal transmission.

Figure 4:
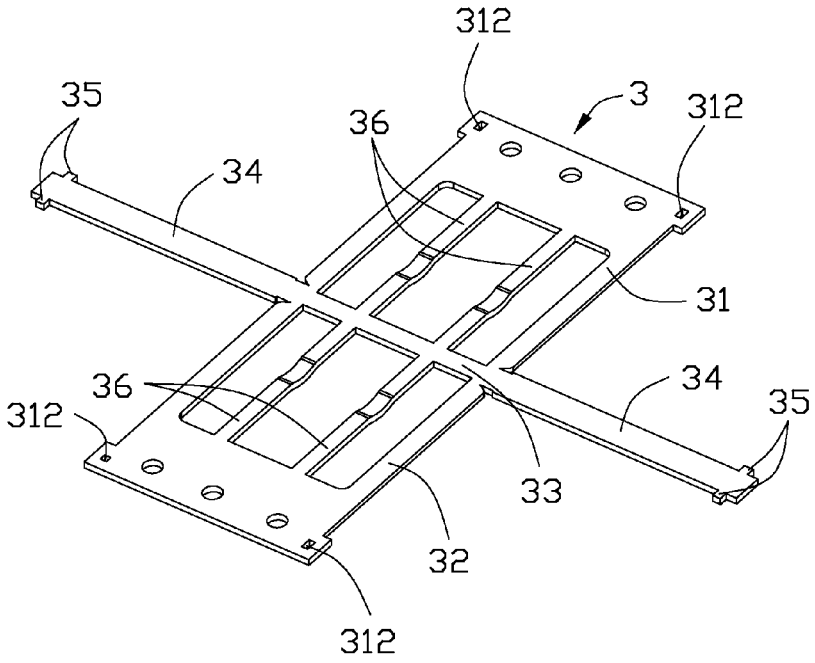
FIG. 4 is a perspective, unfolded view of a metal shield of the plug connector.

Referring to FIGS. 2-4, the metal shield 3 comprises a top wall 31, a bottom wall 32, a front wall 33 connecting with the top wall 31 and the bottom wall 32, and a pair of sidewalls 34 extending sidewardly from two lateral edges of the front wall 33 and retained between the top wall 31 and the bottom wall 32. Each sidewall 34 has a pair of protrusions 35 respectively on an upper edge and a lower edge thereof. Each of the top wall 31 and the bottom wall 32 has a number of cutouts 312 correspondingly receiving the protrusions 35 for retaining the sidewalls 34 between the top wall 31 and the bottom wall 32. Each of the top wall 31 and the bottom wall 32 has a plurality of ribs 36 extending along the mating direction. The ribs 36 are correspondingly received in the slits 17 for intensifying engagement between the insulative housing 1 and the metal shield 3. The ribs 36 and the raised portions 16 are planar to function as a tongue portion (not labeled) for being inserted in the USB receptacle connector. Each rib 36 forms a bulge 361 higher than a planar surface defined by the ribs 36 and the raised portion 16 for intensifying engagement between the USB plug connector 100 and the USB receptacle connector. Each of the top wall 31 and the bottom wall 32 defines a plurality of apertures 37 between the cutouts 312. The metal shield 3 has a plurality of inclined portions 3312 between the front wall 33 and the top wall 31 as well as between the front wall 33 and the bottom wall 32 for guiding and facilitating insertion of the USB plug connector 100 into the USB receptacle connector.

Referring to FIG. 4, is an unfolded view of the metal shield 3. The metal shield 3 is stamped from a metal piece. The top wall 31, the bottom wall 32, the front wall 33, and the pair of sidewalls 34 are shaped as a cross when the metal shield 3 is unfolded. In another saying, the top wall 31, the front wall 33, and the bottom wall 32 cooperatively define a first straight line along a first direction and the sidewalls 34 and the front wall 33 cooperatively define a second straight line along a second direction perpendicular to the first direction.

Figure 5:
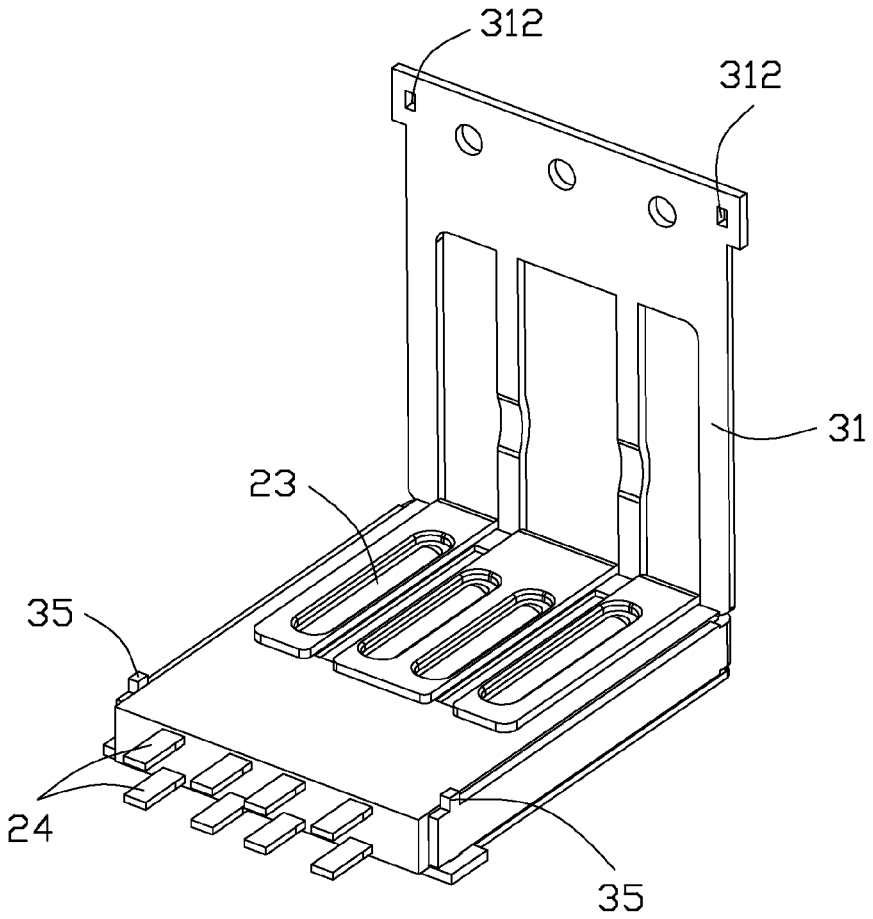
FIG. 5 is a first, perspective, and partly assembled view of the plug connector.
Figure 6:
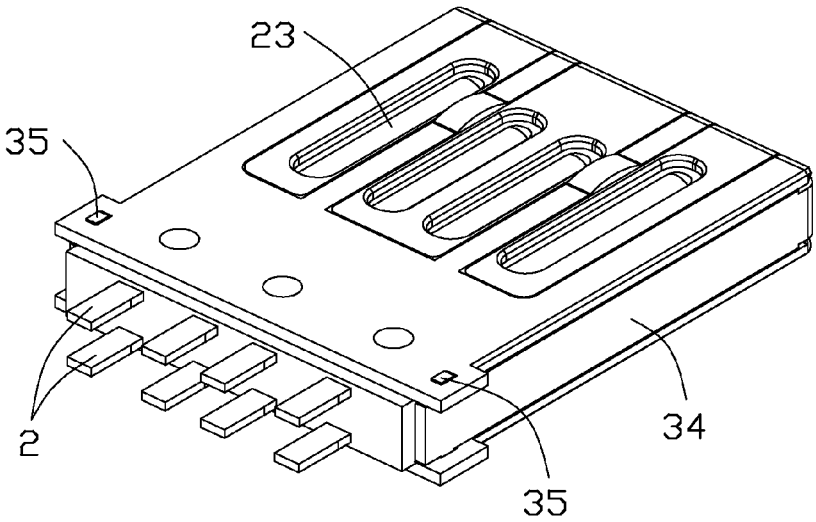
FIG. 6 is a second, perspective, and partly assembled view of the plug connector.

Referring to FIGS. 1, 5, and 6, a method for manufacturing the USB plug connector 100 comprises a plurality of following steps:

Step 1: Providing a plurality of contacts 2 having a row of upper contacts 21 and a row of lower contacts 22, thereby the contacts 2 having a plurality of soldering portions 24 arranged in two upper and lower rows, and insert-molding an insulative housing 1 which retains the contacts 2;

step 2: Stamping a metal piece to form a metal shield 3 which has a top wall 31, a bottom wall 32, a front wall 33, and a pair of sidewalls 34 and is substantially cross shaped when the metal shield 3 is at a first, unfolded state, each sidewall 34 having a pair of protrusions 35 respectively on an upper edge and a lower edge thereof, each of the top wall 31 and the bottom wall 32 having a number of cutouts 312 correspondingly receiving the protrusions 35, assembling the insulative housing 1 to the metal shield 3 when the metal shield 3 is at the first, unfolded state;

step 3: Assembling and retaining the top wall 31 and the bottom wall 32 onto the sidewalls 34 so as to peripherally define a receiving space with the protrusions 35 of the sidewalls 34 received in the cutouts 312 of the top wall 31 and the bottom wall 32, thereby retaining the insulative housing 1 in the receiving space of the metal shield 3 when the metal shield 3 is at a second, folded state;

step 4: Sandwiching a PCB 4 between the upper and lower arranged soldering portions 24, electrically connecting the upper power contact 211 with the lower power contact 221, the upper, first signal contact 212 with the lower, first signal contact 222, the upper, second signal contact 213 with the lower, second signal contact 223, and the upper grounding contact 214 with the lower grounding contact 224 to make sure the USB plug connector 100 is capable of being normally and reversely inserted into the USB receptacle connector;

step 5: Connecting the cable 6 with the PCB 4; and step 6: Partly over-molding the insulative cover 5 on the metal shield 4 and during the over-molding, plastic material is filled in the apertures 37 to make sure that the metal shield 4 is retained with the insulative cover 5.

Because the metal shield 3 of the USB plug connector 100 of the present invention has two states and the insulative housing 1 with the retained contacts 2 is assembled to the metal shield 3 at its first, unfolded state, it makes sure that an inconvenient and inaccurate assembling the metal shield 3 on the insulative housing 2.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A USB (Universal Serial Bus) plug connector comprising:

an insulative housing;

a plurality of contacts retained in the insulative housing;

a metal shield covering the insulative housing, the metal shield comprising a top wall, a bottom wall, a front wall connecting with the top wall and the bottom wall, and a pair of sidewalls extending sidewardly from two lateral edges of the front wall and retained between the top wall and the bottom wall, each sidewall having a pair of protrusions respectively on an upper edge and a lower edge thereof, each of the top wall and the bottom wall having a number of cutouts correspondingly receiving the protrusions for retaining the sidewalls between the top wall and the bottom wall; and the metal shield is folded from a substantially cross shaped unfolded state, and the top wall, the front wall, the bottom wall, and the sidewalls of the metal shield in its folded state cooperatively define a receiving space;

a printed circuit board soldered with the contacts;

an insulative cover molded over a part of the metal shield; and a cable connecting to the printed circuit board for electrically connecting with the contacts; and wherein the insulative housing has a plurality of raised portions protruding from both an upper face and a lower face thereof, a slit is defined between every two adjacent raised portions on each of the upper face and the lower face, and each of the top wall and the bottom wall has a plurality of ribs correspondingly received in the slits.

2. The USB plug connector as claimed in claim 1, wherein the top wall, the front wall, and the bottom wall cooperatively define a first straight line along a first direction and the sidewalls and the front wall cooperatively define a second straight line along a second direction perpendicular to the first direction.

3. The USB plug connector as claimed in claim 1, wherein the ribs and the raised portions are planar.

4. The USB plug connector as claimed in claim 3, wherein each rib forms a bulge higher than a planar surface defined by the ribs and the raised portion.

5. The USB plug connector as claimed in claim 1, wherein each raised portion defines a lengthwise extending slot and the contacts have a plurality of contacting portions positioned in the lengthwise extending slots.

6. The USB plug connector as claimed in claim 5, wherein the contacting portions are received in the lengthwise extending slots and lower than the raised portions.

7. An electrical connector comprising:

a terminal module including an insulative housing with a plurality of conductive contacts embedded therein, said housing defining opposite upper and bottom faces in a vertical direction, a front face and two opposite side faces, a raised area formed on each of said upper and bottom faces, each of said contacts defining a front contacting section exposed upon the raised area and a rear connecting section extending outward of the housing;

a metallic shell formed from metallic sheet with a constant thickness thereof, and forming opposite top and bottom walls with openings therein to cover the opposite top and bottom faces with the raised areas received in the openings and exposed in the vertical direction, and a front wall linked between said opposite top and bottom walls to cover the front face in a front-to-back direction perpendicular to said vertical direction; and wherein said top wall and said bottom wall define a plurality of ribs to divide the corresponding opening into sectors, and the raised area defines a plurality of slits to form a plurality of separated sections to be received in the corresponding sectors of the corresponding opening, respectively; and a cable located behind the terminal module and including a plurality of wires electrically connected to the rear connecting sections of the corresponding contacts, respectively.

8. The electrical connector as claimed in claim 7, wherein said shell further includes a pair of lateral side walls each respectively engaged with both the top wall and the bottom wall so as to keep rear portions of said top and bottom walls in position.

9. The electrical connector as claimed in claim 8, wherein the opposite top and bottom walls and the opposite lateral side walls all commonly unitarily extend from different edges of the front wall.

10. The electrical connector as claimed in claim 9, wherein each of said ribs includes a bulge projecting outwardly in the vertical direction.

11. The electrical connector as claimed in claim 7, further including a printed circuit board connected between the wires and the rear connecting sections of the contacts.

12. The electrical connector as claimed in claim 7, further including an insulative cover overmolded upon the a rear portion of the shell, wherein said top wall and said bottom wall define plural apertures.

* * * * *